United States Patent [19]

Cook

[11] Patent Number: 4,995,369

[45] Date of Patent: Feb. 26, 1991

[54] REGULATED FLOW CANISTER PURGE SYSTEM

[75] Inventor: John E. Cook, Chatham, Canada

[73] Assignee: Siemens-Bendix Automotive Electronics Limited, Chatham, Canada

[21] Appl. No.: 452,664

[22] Filed: Dec. 18, 1989

[51] Int. Cl.[5] ..... F02M 25/08

[52] U.S. Cl. ..... 123/520

[58] Field of Search ..... 123/518–520

[56] References Cited

U.S. PATENT DOCUMENTS

| | | | |
|---|---|---|---|
| 3,575,152 | 4/1971 | Wentworth | 123/520 |
| 4,703,738 | 11/1987 | DeMinco et al. | 123/520 |
| 4,763,634 | 8/1988 | Morozumi | 123/520 |

*Primary Examiner*—Tony M. Argenbright

*Attorney, Agent, or Firm*—George L. Boller; Russel C. Wells

[57] ABSTRACT

The evaporative emission control system for an internal combustion engine purges the vapor collection canister to the throttle body through both a purge regulator controlled by the engine ECU and a variable orifice valve that is mechanically operated by the throttle mechanism. A throttle position sensor that supplies a throttle position signal to the ECU can be read by the ECU as also representing the degree of restriction being imposed by the variable orifice on the flow of vapor from the canister to the throttle body and the ECU can take this into account when setting the purge regulator.

20 Claims, 2 Drawing Sheets

REGULATED FLOW CANISTER PURGE SYSTEM

BACKGROUND AND SUMMARY OF THE INVENTION

This invention relates to evaporative emission control systems of the type that are commonly used in association with internal combustion engines of automotive vehicles.

In such an evaporative emission control system, excess fuel vapors from the fuel tank are collected in a canister which must be periodically purged to the engine's induction system so that the vapors can pass into the engine's cylinders for combustion. In this way, the excess vapors do not escape to atmosphere where they may otherwise contribute to air pollution. The periodic purging of the vapor collection canister is conducted when conditions conducive to purging exist, and therefore it is a customary practice to have a canister purge solenoid (CPS) valve exercise control over the venting of the canister to the induction system and to place the CPS under the control of the engine electronic control unit (ECU). Because the ECU receives signals representing various engine operating parameters, it can be programmed to allow purging of the canister at different rates depending upon the prevailing engine operating conditions. Thus at certain times, greater amounts of purging may be permitted while at others, lesser amounts may be allowed.

Governmental regulations establish limits for the amount of fuel vapor that is permitted to be emitted from an automotive vehicle to atmosphere. The establishment of stricter regulations may impose heavier burdens on evaporative emission control systems such that the present systems may not be able to achieve compliance. Accordingly, there is a need for further improvement in the existing evaporative emission control systems of automotive vehicles so that increased flow rates of excess fuel vapors can be successfully handled. The present invention is directed to a solution for meeting this need.

The disclosed preferred embodiment of the present invention comprises the inclusion of a variable orifice in the vapor flow path from the canister to the induction system and the use of the engine's throttle to exercise control over the degree of restriction imposed by the variable orifice on the vapor flow path to the induction system. The variable orifice is progressively increasingly restricted as the engine is progressively increasingly throttled. A purge regulator that is under the control of the engine ECU also exercises control over the vapor flow to the induction system. The ECU is programmed using conventional programming techniques to produce a desired degree of purge flow regulation in accordance with engine operating conditions detected by the ECU. Thus, principles of the invention contemplate the conjoint control of the vapor flow from the canister to the induction system by the throttle's control of the variable orifice and by the ECU's control of the purge regulator.

A modern internal combustion engine that contains an ECU typically has a throttle position sensor that provides to the ECU an indication of the instantaneous throttle position. By having the variable orifice directly controlled by the throttle, the throttle position sensor signal is made inherently representative of the degree of restriction imposed by the variable orifice on vapor flow from the canister to the induction passage. Thus, the ECU can "read" the variable orifice and take that reading into account as it exercises control over the purge regulator.

The invention is well suited for providing controlled canister purging over a large dynamic range extending from engine idle to wide open throttle. It is also capable of providing a steadier flow that is beneficial in attenuating hydrocarbon emission spikes in the engine exhaust.

The foregoing features, advantages, and benefits of the invention, along with additional ones, will be seen in the ensuing description and claims, which should be considered in conjunction with the accompanying drawings. The drawings disclose a presently preferred embodiment of the invention in accordance with the best mode contemplated at this time in carrying out the invention.

BRIEF DESCRIPTION OF THE DRAWINGS

FIG. 2 is a view looking in the direction of arrows 2—2 in FIG. 1.

FIG. 3 is a view similar to FIG. 2, but illustrating another position of operation.

FIG. 4 is a graph plot of actual test flow data useful in explaining principles of the invention.

DESCRIPTION OF THE PREFERRED EMBODIMENT

Figure 1:
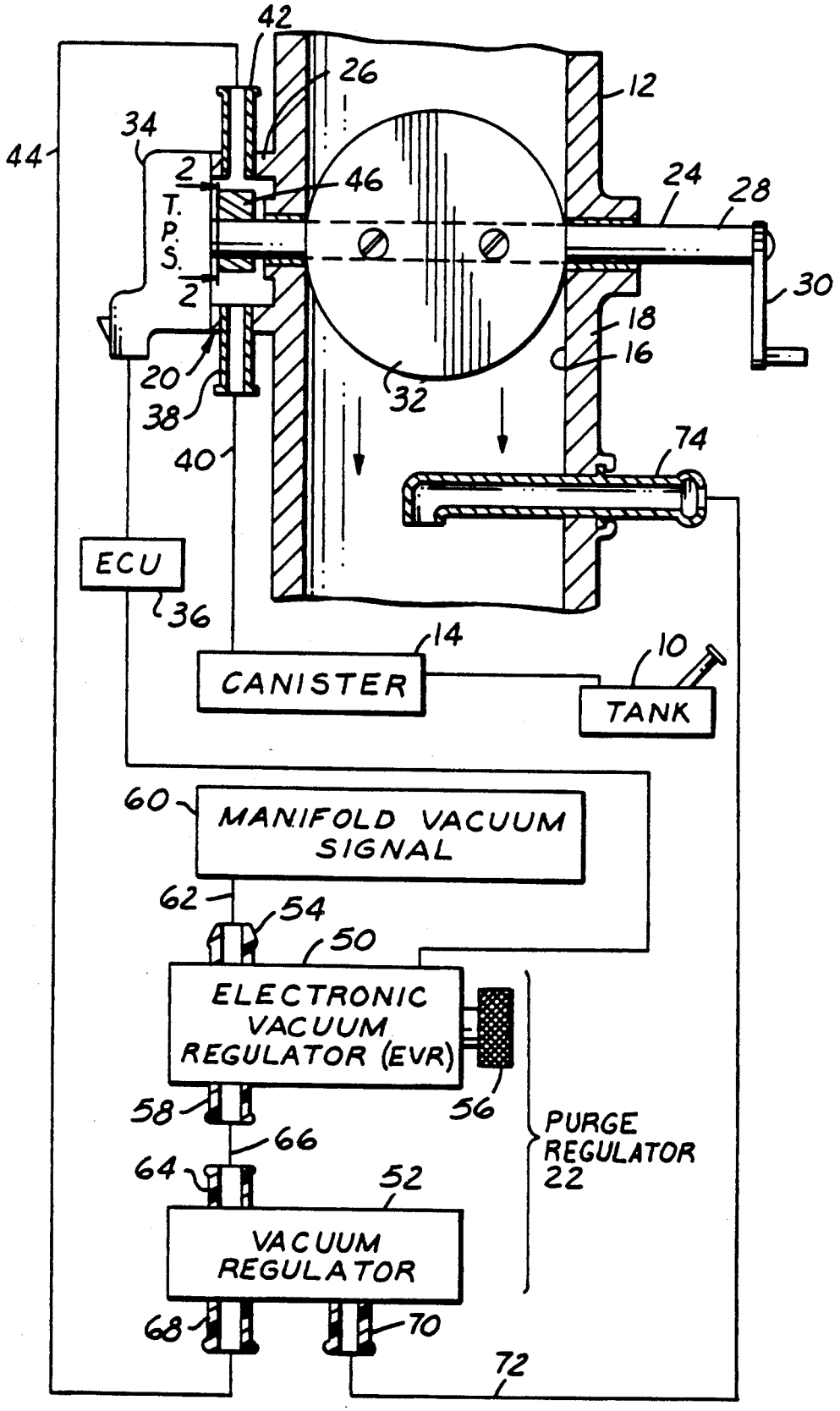
FIG. 1 is a schematic diagram presenting the presently preferred embodiment of regulated flow canister purge system according to the present invention.

An automotive vehicle that is powered by an internal combustion engine includes a fuel tank 10 and a throttle assembly 12. Excess fuel vapors that are vented from tank 10 are collected in a canister 14. The collected vapors are exhausted from canister 14 to the air induction passage 16 that passes through the body 18 of throttle assembly 12 with the passage of the vapors being under the conjoint control of a variable orifice valve 20 and a purge regulator 22.

Variable orifice valve 20 is operated directly by the throttle mechanism 24 of throttle assembly 12. Valve 20 comprises a body 26 that is fixedly mounted on the outside wall of throttle body 18.

Throttle mechanism 24 comprises a shaft 28 that is arranged perpendicular to the direction of induction air flow through passage 16 and is journaled for rotation on the throttle body. Shaft 28 is operated by a crank 30 that is linked to the vehicle accelerator pedal (not shown). A throttle blade, or butterfly, 32 is fastened to shaft 28 within passage 16. The extent to which shaft 28 is operated by crank 30 determines the position of butterfly 32 within passage 16 and hence the degree of throttling of the engine.

The end of shaft 28 opposite crank 30 passes through body 26 to operate a throttle position sensor (TPS) 34 that is disposed outboard of variable orifice valve 20. TPS 34 is one of a number of inputs to an engine electronic control unit (ECU) 36, the other inputs to the ECU not appearing in FIG. 1. TPS 34 provides to ECU 36 an electrical signal indicative of the instantaneous throttle position.

ECU 36 controls a number of engine operating functions, such as fuel, spark, etc. It also exercises control over purge regulator 22.

Details of variable orifice valve 20 include an inlet nipple 38 providing for the connection of a hose 40 from canister 14 and an outlet nipple 42 providing for connection of a hose 44 to purge regulator 22. Disposed within the interior of valve body 26 and affixed to shaft 28 is a valving member in the form of a rotary cam 46.

As shown in FIGS. 2 and 3, cam 46 has a profile 48 that is adapted to coact with the interior end of nipple 42 as the throttle shaft rotates thereby providing a variable restriction. FIG. 1 shows throttle blade 32 in essentially the wide open throttle position, and the corresponding position portrayed by FIG. 2 represents the minimum restriction position of the variable orifice valve.

As the throttle is progressively operated from the wide open throttle position toward engine idle position, cam 46 rotates in the clockwise sense as viewed in FIG. 2 to progressively increasingly restrict the variable orifice. At engine idle, as represented by FIG. 3, the variable orifice imposes maximum restriction to flow from canister 14. Since TPS 34 is being concurrently operated with cam 46, the TPS signal to ECU 36 is inherently representative of the degree of restriction being imposed by the variable orifice valve on vapor flow from the canister. In this way, the ECU can "read" the TPS to determine the restriction being imposed on the flow from the canister.

Purge regulator 22 may be considered to comprise two conventional components, namely an electronic vacuum regulator (EVR) 50 and a vacuum regulator 52. A device like that described in commonly assigned U.S. Pat. No. 4,850,384 is suitable for EVR 50. The EVR has a vacuum inlet nipple 54, an atmospheric vent 56, and a vacuum outlet nipple 58. Nipple 54 is connected to a vacuum signal source, namely engine manifold vacuum 60, by a hose 62. The EVR contains a solenoid that is pulse width modulated by ECU 36. In this way the vacuum level that appears at nipple 58 is controlled by ECU 36.

Vacuum regulator 52 comprises a control nipple 64 that is connected to nipple 58 by a hose 66. It also has an inlet nipple 68 to which hose 44 is connected and an outlet nipple 70 connected by a hose 72 to a nipple 74 that extends through the wall of throttle body 18 at a location downstream of throttle blade 32. Vacuum regulator 52 is responsive to the vacuum output of EVR 50 to regulate the flow through the vacuum regulator from nipple 68 to nipple 70. The larger the vacuum delivered to nipple 64, the more flow is permitted from nipple 68 to nipple 70, and the smaller the vacuum delivered to nipple 64, the less flow is permitted from nipple 68 to nipple 70. And so it can be appreciated that the vapor flow that is permitted by purge regulator 22 is under the control of ECU 36.

Accordingly, it can be further appreciated that the vapor flow from canister 14 to induction passage 16 is a function both of the throttle position as the throttle shaft controls variable orifice valve 20, and of the degree to which ECU 36 permits flow through purge regulator 22.

The effect of variable orifice valve 20 on the canister purge process can be nicely explained with reference to FIG. 4. For a given pressure drop across the valve, there exists a corresponding graph plot that charts the flow rate through the valve as a function of throttle blade position. FIG. 4 presents, by way of example, a series of six individual graph plots, each of which corresponds to a specific pressure drop across the variable orifice valve 20. The pressure drops that are represented in FIG. 4 are, in terms of inches of water, 0.5 inch, 1.0 inch, 1.5 inches, 2.0 inches, 3.0 inches, 4.0 inches. For a given pressure drop, the corresponding graph plot depicts the flow rate through the variable orifice valve 20 as a function of the amount of throttle blade opening between fully open and closed throttle conditions. Stated another way, for a given throttle position, the flow vs. pressure drop characteristic is defined for valve 20. Because the throttle position sensor provides the ECU with the capability of reading the variable orifice, suitable mapping of the ECU such as in the exemplary manner of FIG. 4 enables the ECU to know the corresponding flow vs. pressure drop characteristic of variable orifice valve 20 for specific throttle blade positions. The ECU can then take this into account when setting purge regulator 22.

The provision of the variable orifice valve 20 under the control of the throttle endows the emission control system with a wide dynamic range, allowing good control from engine idle to wide open throttle. As a result, the system can achieve compliance with stricter evaporative emission standards. The solenoid of EVR 50 is operated by a frequency of signal from the ECU which is considerably higher than that used to control previously used CPS valves. (12514 150 hz vs 10–20 hz, typically). This serves to attenuate hydrocarbon spikes in exhaust emission.

The invention can therefore be seen to constitute an improvement in evaporative emission control systems. While a presently preferred embodiment of the invention has been illustrated and described, it will be appreciated that principles are applicable to other embodiments. For example, the variable orifice valve 20 need not necessarily be mounted directly on the throttle body although such a mounting will be advantageous in certain installations. The valve can be organized and arranged in any suitable manner to be responsive to throttle position. Moreover, while a rotary cam is an advantageous embodiment for the valving member, other embodiments of valving member can be employed.

What is claimed is:

1: In an evaporative emission control system of an internal combustion engine wherein volatile fuel that has evaporated from a liquid fuel tank is collected in a collection canister that, under certain engine operating conditions detected by an electronic control system of the engine, is purged to the engine by a purge regulator under the control of said electronic control system so as to cause collected fuel vapors to be combusted by the engine, the improvement which comprises a variable orifice that conjointly with said purge regulator exercises control over the vapor flow from said canister to the engine and functions to selectively restrict vapor flow from the canister to the engine in correlation with the degree to which the engine is being throttled, and a sensor for supplying the electronic control system with a signal indicative of the degree to which the engine is being throttled and hence also the degree of restriction imposed by said variable orifice on the flow from the canister to the engine so that the electronic control system can take the degree of restriction imposed by said variable orifice into account in setting the purge regulator.

2. The improvement set forth in claim 1 in which the variable orifice is increasingly restricted as the engine is increasingly throttled.

3. The improvement set forth in claim 2 in which the variable orifice comprises a rotary cam that is rotated to provide the degree of restriction imposed by the variable orifice.

4. In an evaporative emission control system of an internal combustion engine wherein fuel that has evaporated from a liquid fuel tank is collected in a collection canister whose purging to a throttleable induction system of the engine is controlled by a solenoid-operated purge regulator in accordance with a command signal from an electronic control system of the engine, the improvement which comprises a variable orifice that conjointly with said purge regulator controls flow from said canister to said induction system and is selectively restricted in correlation with the degree to which the induction system is being throttled, and a sensor for supplying the electronic control system with a signal indicative of the degree to which the induction system is being throttled and hence also the degree of restriction imposed by said variable orifice on the flow from said canister to said induction system so that the electronic control system can take the degree of restriction imposed by said variable orifice into account in setting the purge regulator.

5. The improvement set forth in claim 4 in which the variable orifice is increasingly restricted as the induction system is increasingly throttled.

6. The improvement set forth in claim 5 in which the variable orifice comprises a rotary cam that is rotated to provide the degree of restriction imposed by the variable orifice.

7. In an internal combustion engine that has an air induction system via which air is inducted into combustion chambers of the engine, a throttle valve mechanism disposed in said induction system for selectively throttling the engine, a fuel system comprising a liquid fuel storage tank for storing volatile liquid fuel and means for causing liquid fuel to be drawn from said tank and introduced into the combustion chambers for combustion with air inducted into the combustion chambers, an electronic engine control system for controlling certain engine functions, and an evaporative emission control system comprising a collection canister that collects fuel vapors from said tank and is purged to the induction system under certain engine operating conditions to cause collected fuel vapors to be entrained with air inducted into the combustion chambers and subsequently combusted in the combustion chambers, said evaporative emission control system having a purge regulator under the control of the electronic engine control system so that purging of the canister to the induction system will occur upon detection of certain engine operating conditions by the electronic engine control system, the improvement which comprises a variable orifice that conjointly with said purge regulator controls purging of the canister to the air induction system and is selectively increasingly restricted as the induction system is increasingly throttled by the throttle mechanism and a sensor that is operated in conjunction with the operation of said variable orifice by the throttle mechanism to provide to the engine electronic control system a signal indicative of the degree of restriction of said variable orifice.

8. The improvement set forth in claim 7 in which said variable orifice is disposed on said induction system in proximity to said throttle valve mechanism.

9. The improvement set forth in claim 8 wherein said throttle valve mechanism comprises a rotary shaft and said variable orifice is controlled by the rotation of said shaft.

10. The improvement set forth in claim 9 in which said sensor is disposed adjacent said variable orifice and is also controlled by said shaft.

11. The improvement set forth in claim 9 in which the degree of restriction of said variable orifice is controlled by a rotary cam affixed to said shaft.

12. The improvement set forth in claim 8 wherein said sensor and said variable orifice are arranged for coaxial control by said throttle valve mechanism.

13. The improvement set forth in claim 7 wherein said sensor and said variable orifice are arranged for coaxial control by said throttle valve mechanism.

14. In an internal combustion engine that has an air induction system via which air is inducted into combustion chambers of the engine, a throttle valve mechanism disposed in said induction system for selectively throttling the engine, a fuel system comprising a liquid fuel storage tank for storing volatile liquid fuel and means for causing liquid fuel to be drawn from said tank and introduced into the combustion chambers for combustion with air inducted into the combustion chambers, an electronic engine control system for controlling certain engine functions, and an evaporative emission control system comprising a collection canister that collects fuel vapors from said tank and is purged to the induction system under certain engine operating conditions to cause collected fuel vapors to be entrained with air inducted into the combustion chambers and subsequently combusted in the combustion chambers, said evaporative emission control system having a purge regulator under the control of the electronic engine control system so that purging of the canister to the induction system will occur upon detection of certain engine operating conditions by the electronic engine control system, the improvement which comprises a variable orifice that conjointly with said purge regulator controls the vapor flow from the canister to the induction system and is selectively restricted by the operation of the throttle mechanism so that the degree of throttling of the engine influences, via said variable orifice, the extent to which vapors can flow from said canister to the induction system.

15. The improvement set forth in claim 14 including a sensor for sensing the extent of throttling of the engine and hence the degree of restriction of said variable orifice, said sensor supplying a signal to the engine electronic control system so that the electronic control system can take the degree of restriction imposed by said variable orifice into account in controlling the purge regulator.

16. In an internal combustion engine having a throttle body, a tank for holding volatile liquid fuel for operating the engine, and an evaporative emission control system associated with said throttle body and said tank for purging fuel vapors collected from said tank to the throttle body, said throttle body having a throttle mechanism for controlling the degree of engine throttling provided by said throttle body, the improvement comprising a variable orifice valve that is operated by the throttle mechanism and exercises control over the vapor flow from the canister to the induction system.

17. The improvement set forth in claim 16 wherein the engine includes an electronic control system, a throttle position sensor operated by said throttle mechanism provides to the electronic control system an electrical signal indicative of the degree of engine throttling, and a purge regulator that is under the control of the electronic control system conjointly with said variable orifice valve exercises authority over the conveyance of collected fuel vapors to the throttle body.

18. The improvement set forth in claim 17 in which collected fuel vapors are conveyed through said variable orifice to the throttle body at a location downstream of said throttle mechanism.

19. In an internal combustion engine comprising a throttle body having a throttle mechanism, a throttle position sensor operated by said throttle mechanism to indicate to an engine ECU the degree of engine throttling provided by said throttle mechanism, a fuel tank for holding volatile liquid fuel for the engine, and an evaporative emission control system comprising a canister that collects fuel vapors from said fuel tank, and means for controllably venting the canister to the throttle body at a location downstream of the throttle mechanism, the improvement wherein said means for controllably venting the canister comprises a solenoid valve controlled by the ECU and a variable orifice controlled by said throttle mechanism.

20. In an internal combustion engine having an induction system, a throttle mechanism for said induction system, and an evaporative emission control system wherein fuel vapors collected from a fuel tank for the engine are controllably purged to the induction system, the improvement which comprises controlling the flow of vapors to the induction system at least in part by conducting them through a variable orifice that is mechanically operated by said throttle mechanism.

* * * * *

UNITED STATES PATENT AND TRADEMARK OFFICE
CERTIFICATE OF CORRECTION

PATENT NO. : 4,995,369

DATED : Feb. 26, 1991

INVENTOR(S) : John E. Cook

It is certified that error appears in the above-identified patent and that said Letters Patent is hereby corrected as shown below:

The drawing sheet, consisting of Figs. 2 - 4, should be added as shown on the attached page.

Column 4, line 24, delete "12514 150 hz" and replace with --125-150 hz--.

Signed and Sealed this

Twenty-second Day of June, 1993

*Attest:*

Michael K. Kirk

MICHAEL K. KIRK

*Attesting Officer*

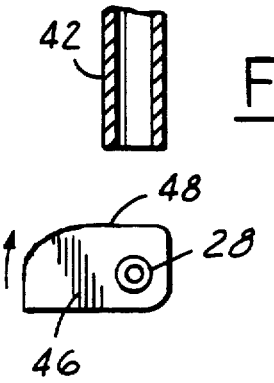
FIG.2
FIG.3
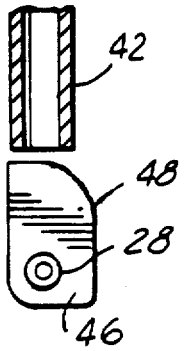
FIG.4
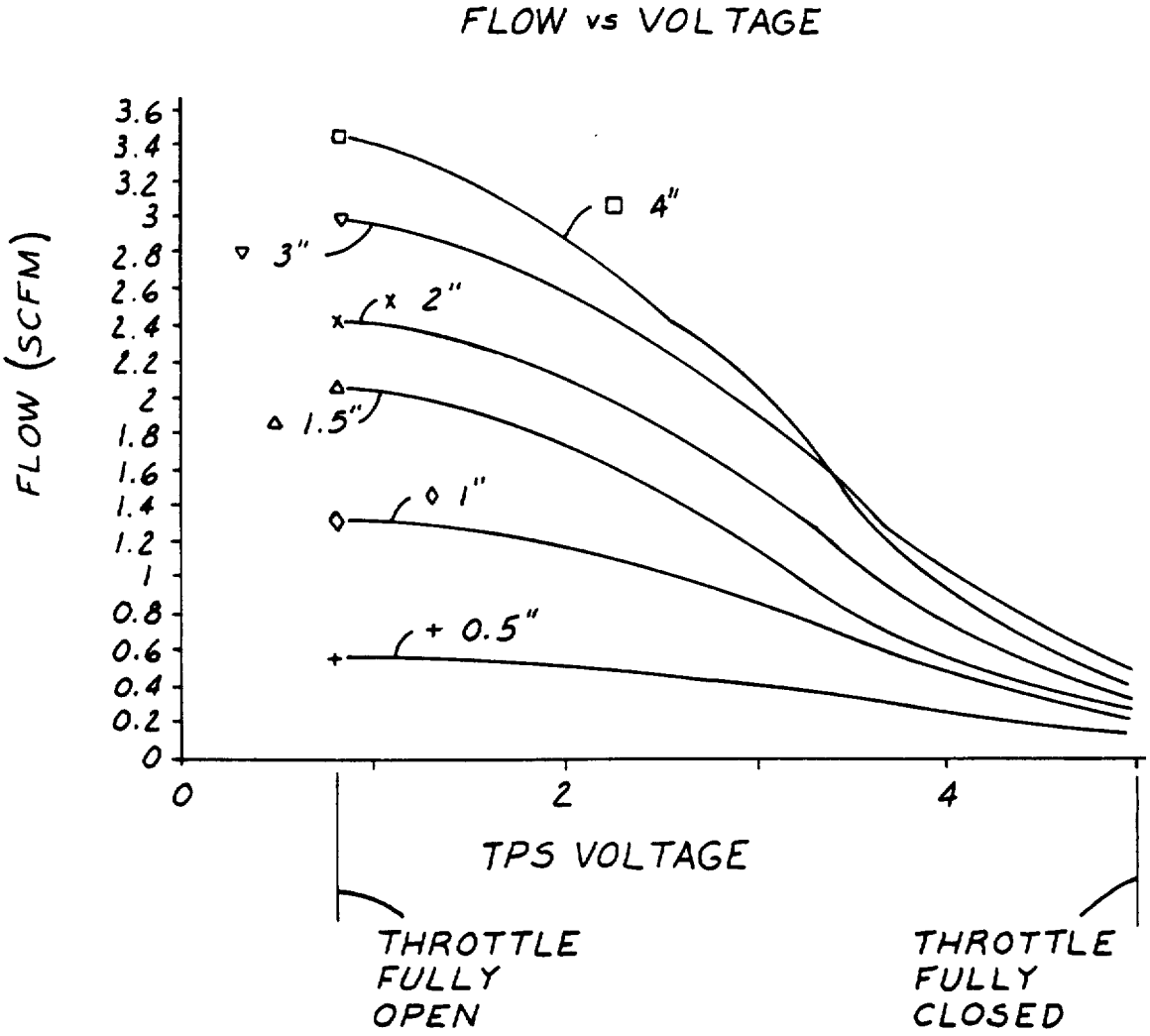

*Acting Commissioner of Patents and Trademarks*